United States Patent [19]

Aikins et al.

[11] Patent Number: 4,483,379

[45] Date of Patent: Nov. 20, 1984

[54] WOOD/LOG PROCESSING MACHINE

[76] Inventors: Warren A. Aikins, 3489 Indian Creek Dr.; Thomas N. Melin, 2231 Cascade Way, both of Longview, Wash. 98632

[21] Appl. No.: 454,193

[22] Filed: Dec. 29, 1982

[51] Int. Cl.[3] ..... B27L 7/00; B27B 1/00

[52] U.S. Cl. ..... 144/366; 83/319; 83/322; 144/2 Z; 144/3 K; 144/193 A; 144/356; 144/367

[58] Field of Search ..... 83/318, 319, 322; 144/2 Z, 3 D, 3 K, 193 R, 193 A, 335, 366, 367, 356

[56] References Cited

U.S. PATENT DOCUMENTS

| | | | |
|---|---|---|---|
| 3,198,225 | 8/1965 | Busch | 144/3 D |
| 3,398,774 | 8/1968 | Hahn | 144/3 D |
| 4,160,470 | 7/1979 | Sigmund | 144/3 K |
| 4,176,696 | 12/1979 | Greeninger | 144/3 K |

*Primary Examiner*—W. D. Bray

*Attorney, Agent, or Firm*—Lee R. Schermerhorn

[57] ABSTRACT

The machine automatically pivots itself into alignment with the orientation of a log being drawn into the machine, and/or pivots the log, and is vertically adjustable to conform to the inclination of a log in process. To cut off an end piece of the log, a shear blade first makes a partial stroke cutting less than entirely through the log. Then the shear blade frame moves away from the input end of the machine, pulling in another length of log. Then the first cut is completed and the shear blade and shear blade frame retract to starting positions for the next cut. This cycle is repeated in automatic operation. When splitting is desired, as for firewood, the shear blade is utilized as a ram to force each end piece of the log through a splitter at the output end of the machine.

22 Claims, 12 Drawing Figures

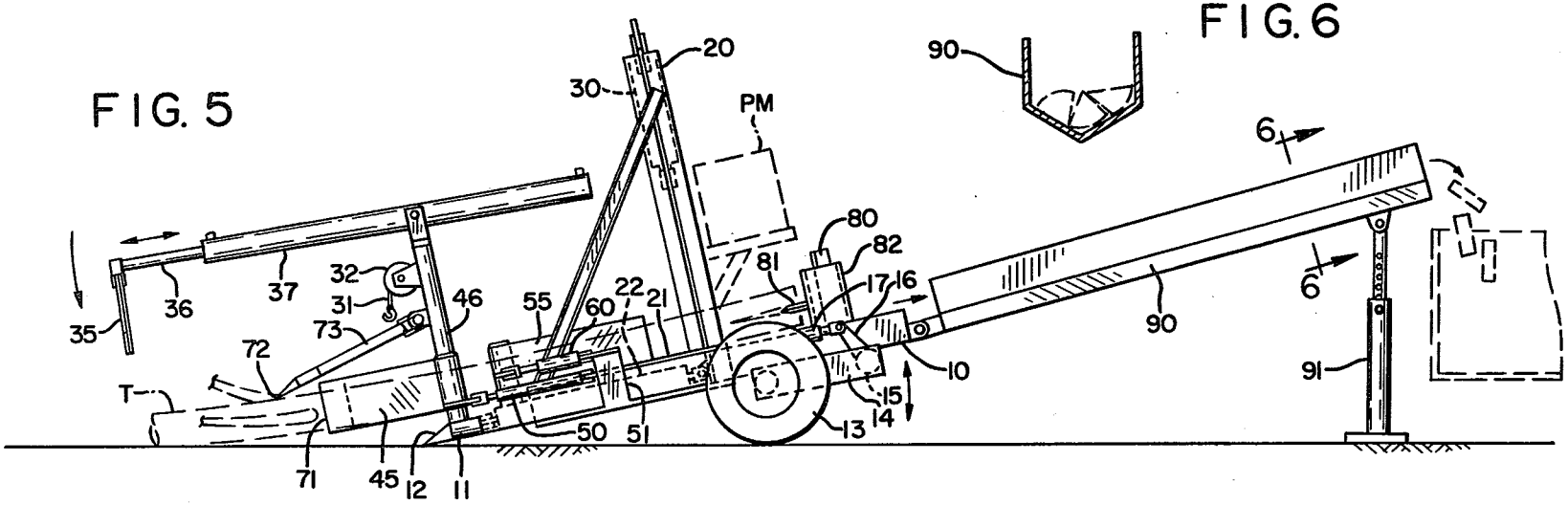
FIG. 6
FIG. 5
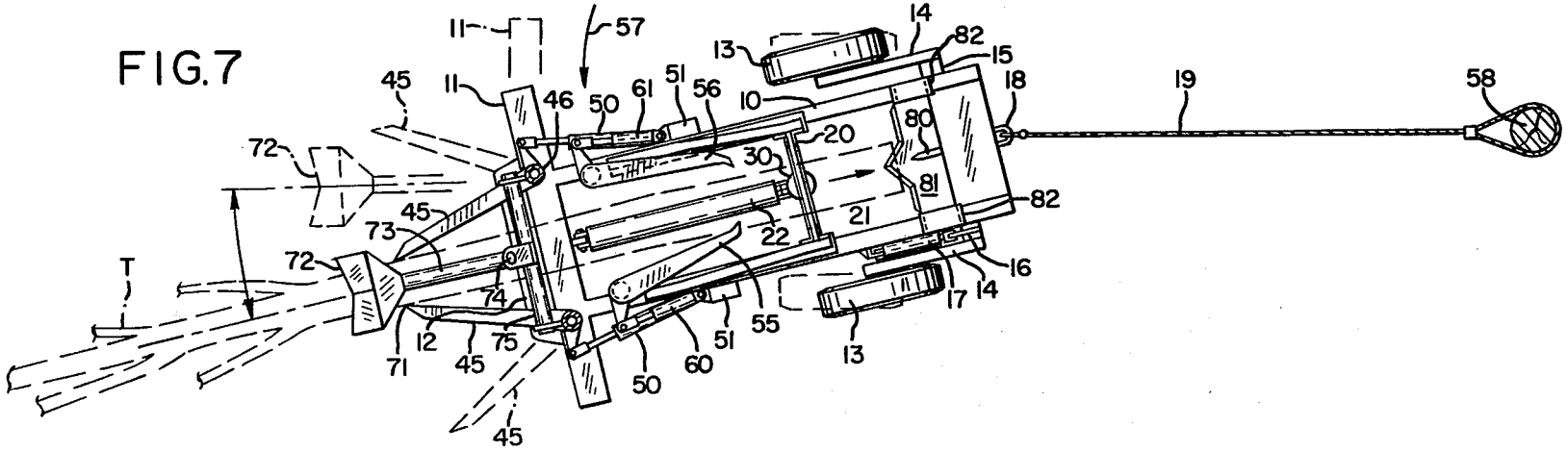
FIG. 7

WOOD/LOG PROCESSING MACHINE

BACKGROUND OF THE INVENTION

This invention relates to a wood/log processing machine for cutting a log into short pieces and for splitting the pieces, as in making firewood.

Processing logs by previous portable machines that are practical for use in the field requires a large amount of human effort and attention. Most machines that are capable of operation with a small amount of human effort and attention are too large and complicated and too expensive to be practical for field use. Attempts to simplify such machines have heretofore resulted in the necessity for a considerable amount of human effort in order to feed the logs into the machine, control a multitude of machine operations and dispose of the finished product. If there is not a sufficient number of human operators, conventional machines suitable for field use are not utilized to capacity and if more human operators are provided, the operation becomes uneconomical.

Thus, there is a need for a relatively simple and inexpensive machine having automatic cycles of operation that minimize the requirement for human operators to the extent that in most situations a single human operator is sufficient.

SUMMARY OF THE INVENTION

The first problem encountered in the field results from the orientations of the logs lying in different directions on the ground. This problem is often solved by dragging the logs up to the machine along a predetermined path but that requires another piece of equipment, such as a tractor, and a tractor driver. The present machine pulls the logs in by itself and automatically turns itself and/or the log into approximate alignment with each with each other without requiring extra equipment or operators.

Another problem often results from the inclination of the log as its leading end is pulled up off the ground and into the machine. The present machine may be tilted to correspond approximately to the inclination of the incoming log so that the log will move through the machine on an inclined path rather than a horizontal path, when necessary. The input end of the machine is nearly at ground level so the log does not have to be elevated more than a few inches.

After the leading end of the log has been introduced into the machine, the first movement of the shear blade which is used to cut off the first end pieces of the log is halted before the end piece is entirely severed from the railing end of the log. Then, the shear blade frame is moved rearward in the machine to pull the log into position for the second cut. During this operation and the other automatic operations to follow, the operator is free to make preparations for pulling in the next log.

After such advancement of the log by movement of the shear blade frame, the shear blade completes its stroke to finish cutting off the partially cut first piece and then returns to its original position to make a second cut less than entirely through the thickness of the log. The next movement of the shear blade frame pulls the log farther into the machine in position for the third cut and this cycle continues automatically while the operator is making preparations for pulling in the next log.

These automatic operations include the splitting of the log pieces for firewood or other purposes when splitting is desired. For this purpose, a splitter is mounted in fixed position at the output end of the machine. In its rearward movement pulling another length of log into the machine, the shear blade, having penetrated less than entirely through the log, is utilized as a ram to force the end piece of the log through the splitter. At the completion of the splitting operation, the stroke of the shear blade is completed as previously described, followed by retraction of the shear blade and retraction of the shear blade frame to its starting position.

This mode of operation permits the use of an inclined chute, without any power driven conveyor, to receive the end piece of the log or the split pieces as the case may be. Each rearward advancement of the shear blade frame pulling in another length of log pushes the cut pieces, or the cut and split pieces, up the inclined chute for discharge into a suitable removal conveyance.

The invention will be better understood and additional objects and advantages will become apparent from the following description of the preferred embodiments illustrated in the accompanying drawings. Various modifications may be made in the construction and arrangement of parts and certain features may be used without others. All such modifications within the scope of the appended claims are included in the invention.

BRIEF DESCRIPTION OF THE DRAWINGS

FIG. 5 is a side elevation view showing certain optional features that may be included.

FIG. 6 is a view on the line 6—6 in FIG. 5.

FIG. 7 is a top plan view showing how the machine automatically aligns itself with the orientation of a log to be processed.

DESCRIPTION OF THE PREFERRED EMBODIMENTS

Figure 1:
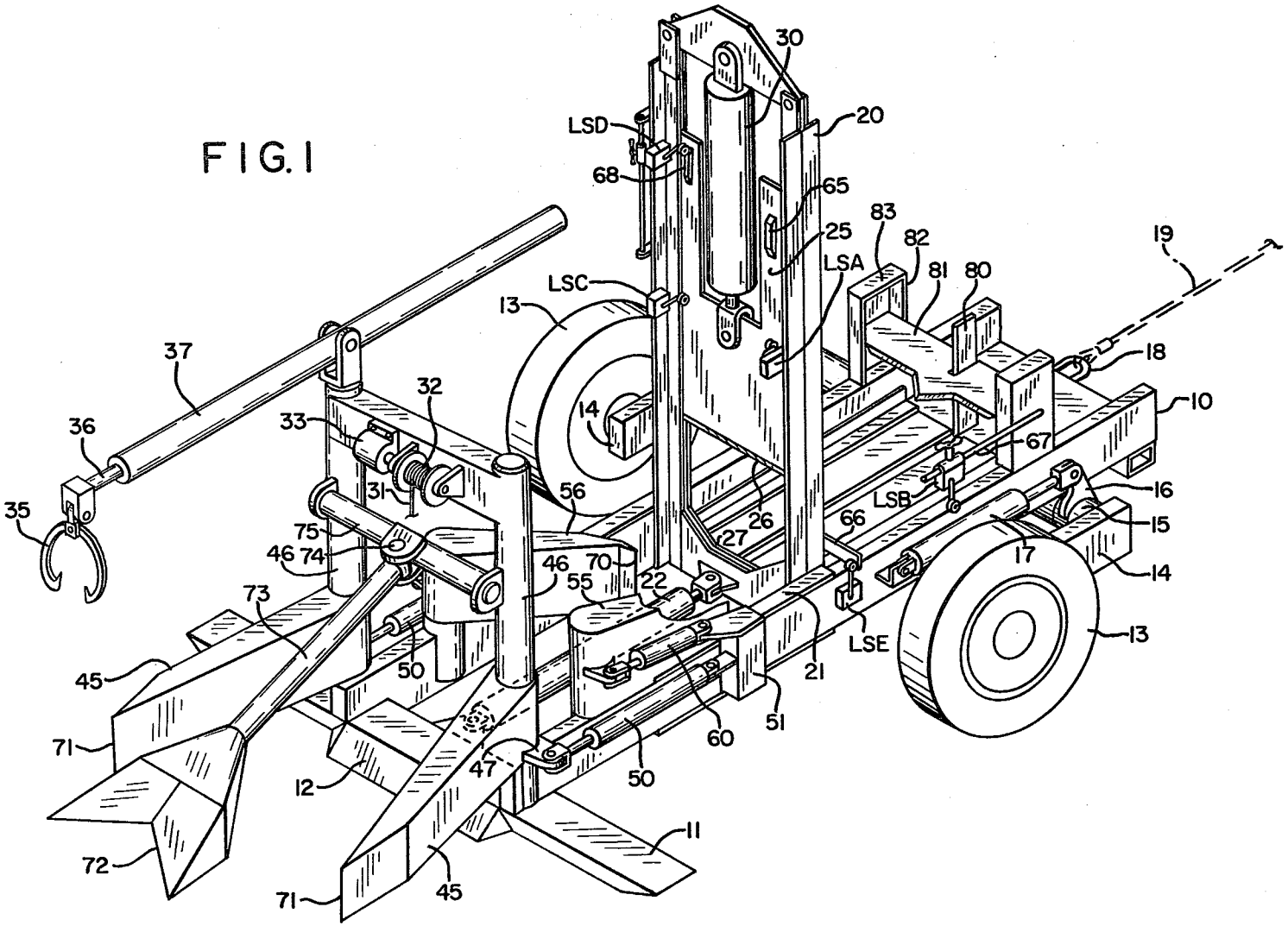
FIG. 1 is an isometric view of a machine embodying the invention.

As seen in FIG. 1, the front or input end of main frame 10 is supported by a transverse stabilizer and skid plate 11 having a forwardly projecting infeed ramp 12 for the logs. The rear or outfeed end of main frame 10 is supported by a pair of wheels 13, each mounted on an axle beam 14 on a swing axle 15 having a lever arm 16 connected to a piston rod in a hydraulic cylinder 17. The rear end of main frame 10 is provided with a tie-down anchor 18 for connection with a length of cable 19.

The lower end of a vertical shear blade frame 20 is mounted on a pair of channel members 21 which provide a carriage for longitudinal sliding movement on the two side frame members of main frame 10. This sliding movement is produced by a hydraulic cylinder 22 connected at its front end to stabilizer and skid plate 11 and having a piston rod connected to the lower end of shear blade frame 20.

A shear blade 25 is slidable vertically in shear blade frame 20. The lower end of shear blade 25 terminates in a knife edge 26 which may be lowered to pass between a pair of plates providing a shear blade anvil 27 at the lower end of shear blade frame 20. Anvil 27 has a depressed central portion to center a log thereon and lessen the horizontal span of the shear blade to prevent bending of the shear blade in a shearing operation. Shear blade 25 is raised and lowered by a piston rod in a hydraulic cylinder 30.

A log may be pulled into the machine over infeed ramp 12 by a cable 31 on a winch drum 32 driven by a hydraulic motor 33 on pivot posts 46. FIG. 5 shows optional equipment for pulling the logs. This comprises log tongs 35 on a piston rod 36 in a hydraulic boom cylinder 37. Cylinder 37 is mounted at its balance point on a pivot post 46 for pivotal movement both horizontally and vertically.

Referring back to FIG. 1, the leading end of a log being pulled into the machine by winch cable 31 or log tongs 35 as above described is guided over ramp 12 by a pair of forward guide arms 45. Guide arms 45 are mounted for swinging movement on a pair of vertical pivot posts 46 on opposite sides of the front end of main frame 10. Each guide arm 45 has an ear 47 connected to a piston rod in a forwardly extending hydraulic cylinder 50, the rear end of which is connected to an anchor block 51 on main frame 10. The forward ends of guide arms 45 may be swung inward under individual control to guide the leading end of the incoming log over the ramp 12 as described.

The present machine is well adapted for use in a location where the logs to be processed are lying in random orientations on the ground. As shown in FIG. 7, the machine will pivot itself and/or the log into approximate alignment with each other. After passing over ramp 12, the leading end of the incoming log encounters rear guide arms 55 and 56 which may be adjusted to convergent positions to direct the leading end of the log over the centrally depressed portion of anvil 27.

If the machine is not in alignment with the log, the machine will pivot on wheels 13 causing skid plate 11 to slide on the ground from its original broken-line position to solid-line position in the direction of arrow 57. The log may then be pulled straight into the machine.

When necessary, cable 19 may be used, the remote end of the cable being connected to a stationary anchor 58 in the ground such as a tree or stump. Ordinarily, cable 19 is not necessary as ramp 12 digs into the ground and prevents the machine from sliding toward the log while still allowing the machine to pivot laterally as described.

As the leading end of the log is pulled across ramp 12 and anvil 27, it will normally be inclined upward above the ground level as shown in FIG. 5. The rear end of main frame 10 may be raised by cylinder 17 to conform to this vertical inclination. Thus, the machine pivots horizontally automatically to align itself with the orientation of a log on the ground to be processed and may also be aligned with the incoming log in a vertical direction.

Figure 2:
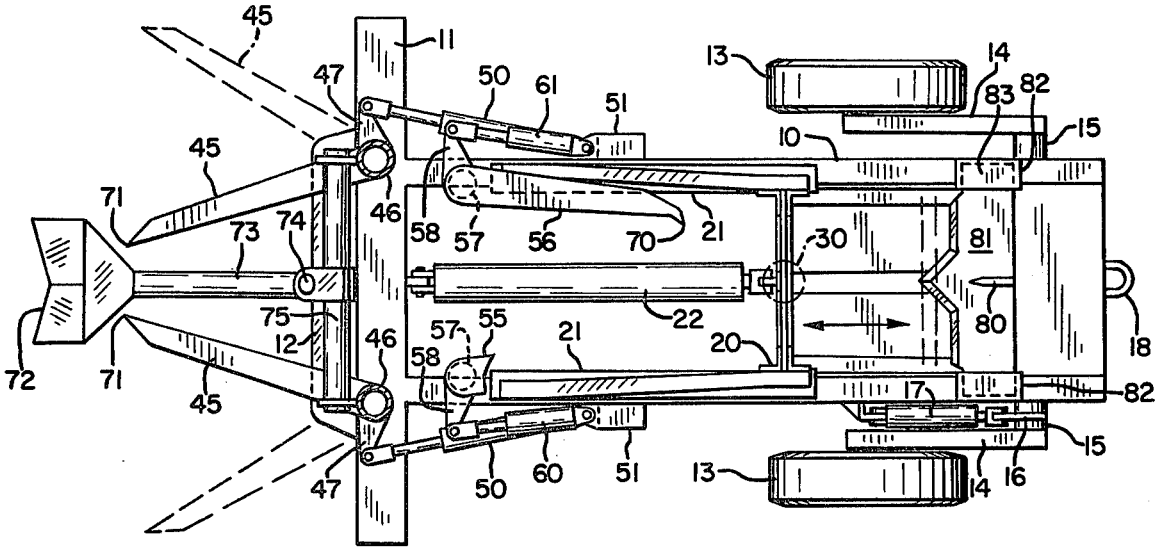
FIG. 2 is a top plan view.

As seen in FIG. 2, the rear guide arms 55 and 56 are mounted on vertical pivot posts 57 and have ears 58 connected to piston rods in cylinders 60 and 61. The front ends of these cylinders are connected to anchor blocks 51 on main frame 10. Thus, the rear guide arms 55 and 56 may be placed in convergent positions to guide an incoming log across anvil 27, the guide arms may be clamped against opposite sides of the log or the guide arms may be retracted clear of the log.

As seen in FIG. 1, the piston rod is fully retracted in cylinder 22 placing shear blade frame 20 in its forward or starting position. The incoming log is pulled across anvil 27 by winch cable 31 or log tongs 35 the desired distance to put the log in position for the first cut by shear blade 25. Upon closing the start switch, repeated cycles of automatic operation will follow, cutting the log into pieces of desired length without further attention by the operator.

Figure 3:
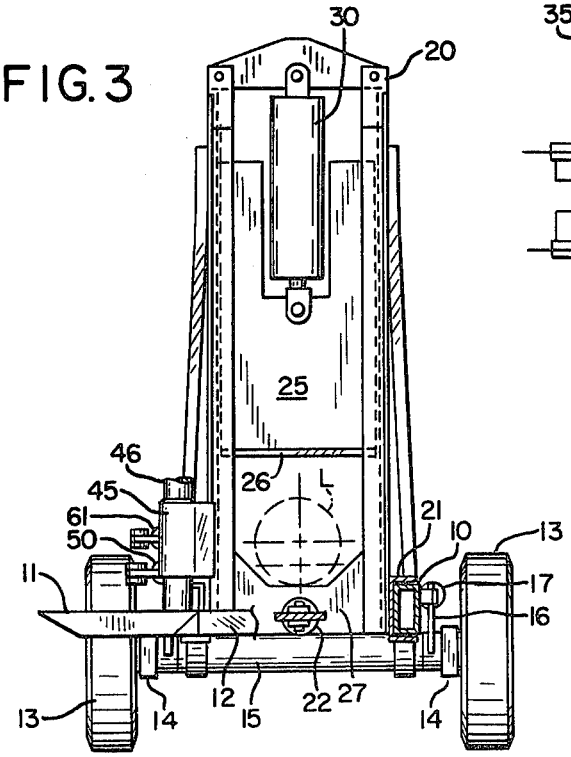
FIG. 3 is a front elevation view with parts broken away and with the front end raised up off the ground in travel position.

The closing of the start switch actuates cylinder 30 to start the downward stroke of shear blade 25 until mechanical protrusion 65 on the shear blade actuates limit switch LSA on shear blade frame 20. This stops the downward movement of the shear blade before it has cut entirely through the log L in FIG. 3, leaving about two inches of uncut wood between the knife edge 26 of the shear blade and the lowest portion of anvil 27. This actuation of limit switch LSA also energizes cylinder 22, extending its piston rod and moving shear blade frame 20 rearward on main frame 10.

Winch cable 31 or log tongs 35 having been disconnected from the log, the shear blade 25 now in deep penetration into the log pulls the log farther into the machine as the shear blade frame 20 moves rearward. When mechanical protrusion 66 on the shear blade frame encounters limit switch LSB, cylinder 22 is de-energized, stopping the movement of the shear blade frame. Limit switch LSB is adjustable on a support rod 67 according to the desired length of the pieces of log to be cut. This actuation of limit switch LSB also re-energizes shear blade cylinder 30 to complete the downward movement of the shear blade and cut off the leading end of the log projecting from the shear blade.

As the shear blade reaches the limit of its downward movement, mechanical protrusion 68 on the shear blade actuates limit switch LSC to reverse the operation of shear blade cylinder 30 and retract the shear blade to the limit of its upward movement. The upward return of shear blade 25 causes mechanical protrusion 68 to actuate limit switch LSD which then de-energizes cylinder 30 and energizes shear blade frame cylinder 22 in the reverse direction to retract its extended piston rod and pull shear blade frame 20 back to its starting position as shown in FIG. 1.

During this return movement of shear blade frame 20, rear guide arms 55 and 56 clamp opposite sides of the log. These guide arms have knife edges 70 to engage the log and hold it against reverse movement while permitting advancing movement.

When shear blade frame 20 returns to its starting position in FIG. 1, its mechanical protrusion 66 actuates limit switch LSE on main frame 10 to energize cylinder 30 for another downward stroke of shear blade 25 to make a second cut in the log. Limit switch LSA limits this downward stroke of the shear blade so that the log is not completely severed and the cycle automatically repeats as described above, pulling another length of log into the machine, cutting off the new end piece and returning the shear blade frame to starting position for a third cut, without the attention of the operator.

The present machine will also cut branches off tree trunks whereby the machine will accept trees T as well as de-limbed logs, as illustrated in FIG. 7. For this purpose, the ends of forward guide arms 45 are provided with knife edges 71 to cut off branches on opposite sides of the tree as the trunk is pulled into the machine. This operation is referred to as side limbing. FIGS. 1 and 5 also show optional equipment for top limbing. This comprises a profiled knife edge 72 on a forwardly extending arm 73 mounted on a vertical pivot 74 on a transverse shaft 75. The opposite ends of shaft 75 are pivotally mounted on the upper ends of posts 46. Limbs on the underside are broken off as the trunk slides over stabilizer and skid plate 11.

The machine in FIG. 1 may also include a splitter. A vertical splitter plate 80 and horizontal splitter plate 81 are vertically floatable as a unit in a pair of vertical support channels 82 on the rear end of main frame 10. The splitter is retained by cover plates 83 on the upper ends of these channels. In each rearward movement of shear blade frame 20, the shear blade 25 operates as a ram to force the leading end of the log into the splitter for making firewood or for other purposes.

This splitter may also be considered as optional equipment because splitting of the cut-off pieces of the log or tree is not always desired. For example, the present machine is well suited for cutting 63-inch pulpwood logs and four foot or eight foot long veneer logs requiring these distances of travel of shear blade frame 20 and its actuating piston rod in cylinder 22.

Another piece of optional equipment is shown in FIGS. 5 and 6. This is an inclined chute 90 having its lower end connected to the rear end of main frame 10 and its upper end supported by an adjustable jack stand 91. Each rearward movement of shear blade frame 20 pushes a previously cut, or cut and split, piece of log out of the machine and upward into chute 90, pushing other previously cut pieces ahead.

Figure 4:
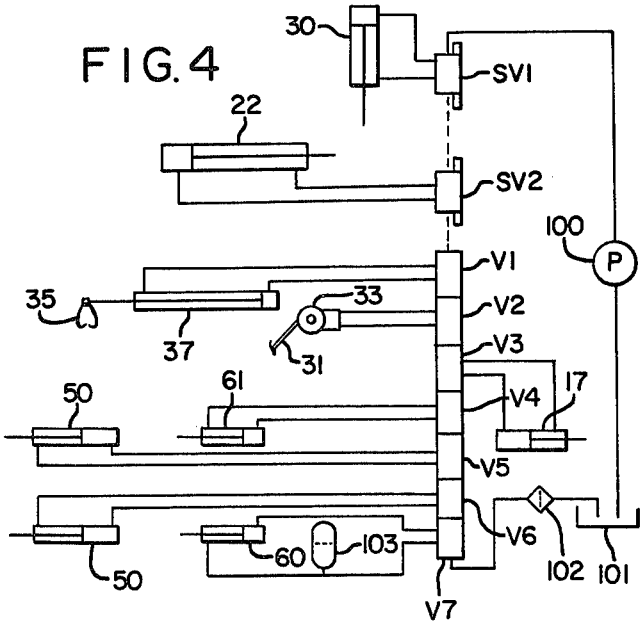
FIG. 4 is a schematic diagram of the hydraulic circuit in the machine.

In the hydraulic system in FIG. 4, pump 100 draws hydraulic fluid from tank 101, after being filtered through filter 102, and pumps it through a series of valves which control the various hydraulic cylinders and hydraulic winch motor described above. Solenoid valve SV1 controls shear blade cylinder 30 and solenoid valve SV2 controls shear blade frame cylinder 22 to produce the described repeating cycles of automatic operation.

Manual valve V1 controls boom cylinder 37 for log tongs 35 and manual valve V2 controls hydraulic winch motor 33 for the pull-in log cable 31. Manual valve V3 controls cylinder 17 to adjust the position of swing axle 15. Manual valve V4 controls the cylinder 61 to adjust the position of rear guide arm 56 and manual valve V5 controls the cylinder 50 to adjust the position of forward guide arm 45 on one side of the main frame.

Manual valve V6 controls cylinder 50 to adjust the position of forward guide arm 45 and manual valve V7 controls cylinder 60 to adjust the position of rear guide arm 55 on the opposite side of the main frame.

The hydraulic circuit between valve V7 and the rod end of cylinder 60 includes a pressure accumulator tank 103 containing nitrogen to provide a resilient clamping force pressing the rear guide arm 55 against one side of the incoming log. This allows the guide arm 55 to yield to irregularities on the log and to accommodate the taper of the log.

FIGS. 8–12 illustrate how the previously described five limit switches control the various operations of the machine in repeating cycles for automatic operation. A 12 volt DC source of supply 109 is provided. The contact arm 111 in each limit switch returns to its upper position when the switch is not actuated by its mechanical protrusion 65, 66 or 68 as previously described.

Figure 8:
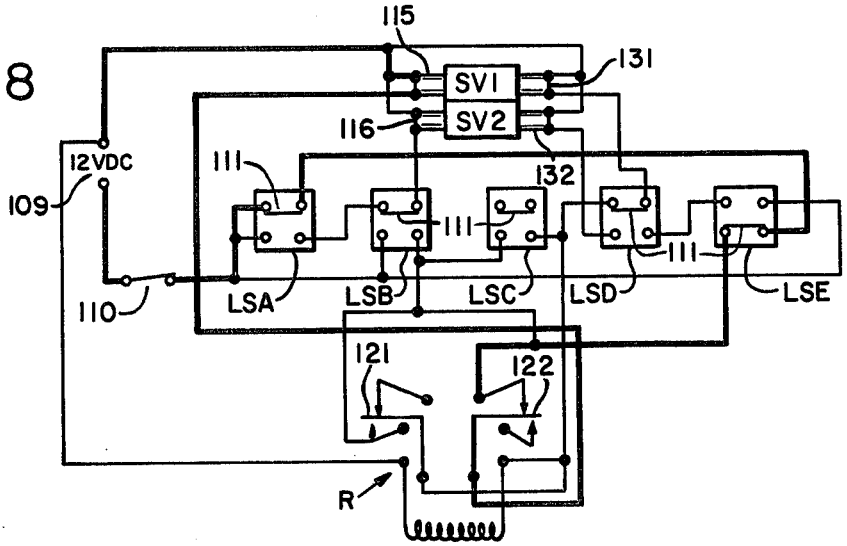
FIGS. 8–12 are schematic diagrams of the electrical control system showing in heavy lines circuits made by limit switches on the mechanical parts in a sequence of movements in automatic operation.

Thus in FIG. 8, before main switch 110 is closed, the contact arm 111 in each limit switch except LSD and LSE would be in its upper position, and the solenoid valves SV1 and SV2 controlling shear blade cylinder 30 and shear blade frame cylinder 22 would be de-energized. In the starting position of the shear blade 25 and shear blade frame 20 shown in FIG. 1, the limit switch LSE is actuated by mechanical protrusion 66 on the shear blade frame and limit switch LSD is actuated by mechanical protrusion 68 on the shear blade.

As previously explained, the leading end of a log to be processed is pulled across anvil 27 in shear blade frame 20 by the winch cable 31 or log tongs 35 to place the log in position for the first cut by shear blade 25. Then the winch cable 31 or log tongs 35 are disconnected from the log and main switch 110 is closed. This closes a circuit, as shown in heavy lines in FIG. 8, through limit switches LSA and LSE and extend solenoid 115 on solenoid valve SV1 to extend the piston rod in shear blade cylinder 30 causing the shear blade to open LSD and penetrate the log.

This circuit includes contact arm 122 in de-energized relay R. Relay R has a pair of contact arms 121 and 122, normally in upper positions, which are pulled down against the lower contacts when the relay is energized.

Figure 9:
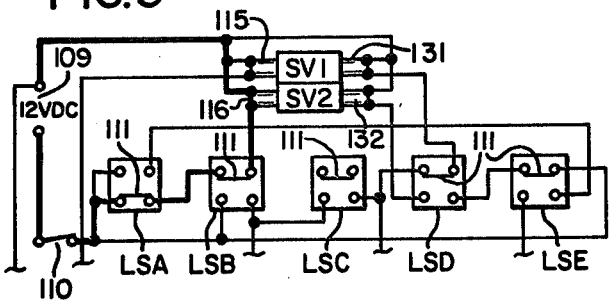

In FIG. 9 the shear blade knife edge 26 has penetrated through 80% of the thickness of log causing the mechanical protrusion 65 to actuate limit switch LSA and energize a different circuit as shown in heavy lines. Switch LSA has opened the circuit to extend solenoid 115 on solenoid valve SV1, stopping the downward movement of the shear blade, and has closed a circuit through extend solenoid 116 on solenoid valve SV2 to extend the piston rod in cylinder 22, moving shear blade frame 20 to the rear, pulling the log along with it and opening LSE.

If splitter 80, 81 is in place, the leading end of the log is split thereby into several pieces but if splitting is not desired, the splitter has been removed from the machine. Relay R is omitted in FIG. 9 because it does not function in this phase of the operation.

The length of stroke of the piston rod in cylinder 22 is limited by the adjusted position of limit switch LSB on its support rod 67. When mechanical protrusion 66 on shear blade frame 20 reaches limit switch LSB, that switch opens the circuit through extend solenoid 116 on solenoid valve SV2, stopping the movement of shear blade frame 20, and closing a circuit through de-energized relay R (contact arm 122) to re-energize extend solenoid 115 on solenoid valve SV1 to complete the downward stroke of the piston rod in shear blade cylinder 30 and cut off the end of the log by operation of the circuit shown in heavy lines in FIG. 10.

Figure 11:
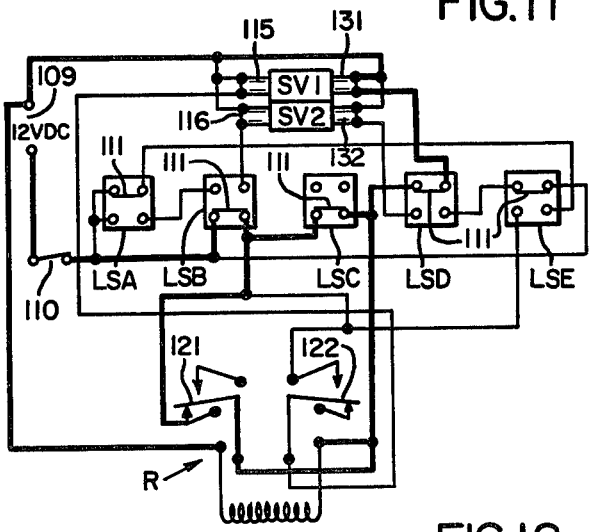
Figure 10:
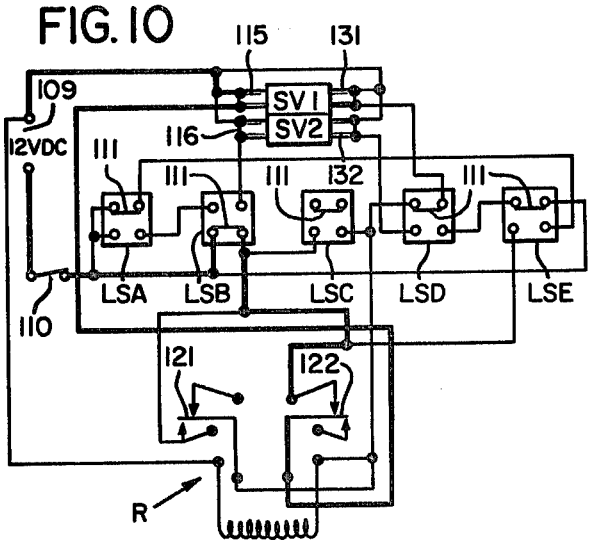

When the shear blade knife edge 26 reaches anvil 27, mechanical protrusion 68 on the shear blade actuates limit switch LSC to energize retract solenoid 131 on solenoid valve SV1, through the circuits shown in heavy lines in FIG. 11. The closing of limit switch LSC energizes the solenoid of relay R, moving its contact arm 121 to lower position as shown. The energization of retract solenoid 131 starts the retract movement of shear blade 25 to its upper position, opening limit switch LSC. The shunt circuit through relay contact arm 121 maintains the energization of the relay coil and retract solenoid 131 after limit switch LSC reopens as the shear blade moves upward.

Figure 12:
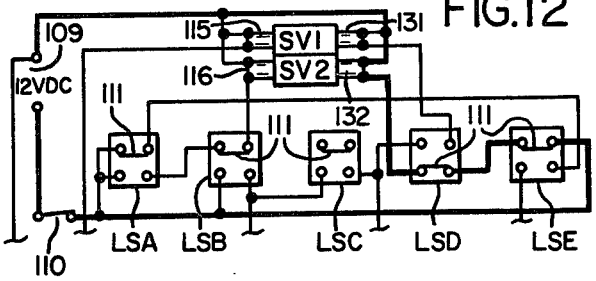

When shear blade 25 has retracted to its upper position, mechanical protrusion 68 actuates limit switch LSD to de-energize retract solenoid 131 and energize retract solenoid 132 on solenoid valve SV2 through a circuit shown in heavy lines in FIG. 12. This retracts shear blade frame 20 allowing limit switch LSB to open, and the shear blade frame moves forward to its starting position in FIG. 1 which actuates limit switch LSE to energize a circuit for starting a new cycle of operations as shown in heavy lines in FIG. 8. Relay R is omitted in FIG. 12 because it does not function in this phase of the operation.

Then the cycle repeats, pulling in another length of log and cutting it off, as long as main switch 110 remains closed. When the entire log has been thus cut into short pieces, the operator opens main switch 110 at the end of a cycle when the shear blade frame 20 has returned to its starting position in FIG. 1 with shear blade 25 retracted. Another log is then pulled into the machine by winch cable 31 or log tongs 35.

The pump P in FIG. 4 is preferably driven by a motor on a towing vehicle or a pump and motor unit may be mounted to energize the hydraulic system as indicated at PM in FIG. 5.

Limit switches LSA, LSB, LSC, LSD and LSE are of the type known in the trade as lever actuated two pole switch with spring return.

Solenoid valves SV1 and SV2 are the type known in the trade as 12 volt DC solenoid operated four way directional control valve with spring return and manual override.

What is claimed is:

1. A wood/log processing machine comprising an elongated main frame, a shear blade frame movable along said main frame, a shear blade in said shear blade frame transverse to the axis of a log in the machine, means for advancing said shear blade less than entirely through the log leaving the leading end of the log connected to its trailing end, means to move said shear blade frame away from the input end of said main frame to advance the log along said main frame, and means to advance the shear blade entirely through the log to shear off said leading end.

2. A machine as defined in claim 1 including means to retract said shear blade, and means to retract said shear blade frame back to another shearing position on the log.

3. A machine as defined in claim 2 including means to prevent the log from sliding backward when said shear blade frame is retracted.

4. A machine as defined in claim 3, said last means comprising a pair of rearwardly extending pivoted guide arms bearing against said trailing end of the log.

5. A machine as defined in claim 4 including resilient actuating means for one of said guide arms.

6. A machine as defined in claim 5, said resilient actuating means including a hydraulic cylinder and a hydraulic pressure accumulator tank in the hydraulic circuit for said cylinder.

7. A machine as defined in claim 5, said guide arms extending rearward toward said shear blade frame from pivotal axes on opposite sides of said input end of said main frame.

8. A machine as defined in claim 1, said means for advancing said shear blade less than entirely through the log comprising a hydraulic cylinder and a limit switch in the path of said shear blade controlling a hydraulic circuit to said cylinder.

9. A machine as defined in claim 1, said means to advance said shear blade entirely through the log comprising a hydraulic cylinder and a limit switch in the path of said shear blade frame while moving away from said input end of said main frame controlling a hydraulic circuit to said cylinder.

10. A machine as defined in claim 1, said means to move said shear blade frame away from said input end of said main frame comprising a hydraulic cylinder and a limit switch in the path of said shear blade controlling a hydraulic circuit to said cylinder.

11. A machine as defined in claim 1 including a log splitter mounted on an output end of said main frame, said shear blade acting as a ram to force said leading end of the log against said splitter when said shear blade frame is moved away from said input end of said main frame while said shear blade is advanced less than entirely through the log.

12. A machine as defined in claim 1 including means to prevent the machine from sliding longitudinally on the ground as the log is advanced through the machine.

13. A machine as defined in claim 12, said last means comprising a tie down anchor on the opposite end of said main frame, a length of cable for connecting said tie down anchor with a stationary anchor in the ground, and a pair of forwardly extending guide arms on said input end of said main frame arranged to receive an incoming log therebetween and pivot said main frame about said tie down anchor to orient said main frame in the direction of said log.

14. A machine as defined in claim 12, said last means comprising a transverse stabilizer and skid plate having an inclined infeed ramp supporting said input end of said main frame.

15. A machine as defined in claim 12 including a pair of wheels supporting the opposite end of said main frame as a trailer vehicle.

16. A machine as defined in claim 15 including a hydraulic cylinder arranged to raise and lower said main frame on said wheels.

17. A machine as defined in claim 1 including an upwardly inclined chute having a lower end connected to the opposite end of said main frame, said chute receiving sheared off pieces of said log pushed into the chute and upward in the chute by said movement of said shear blade frame away from said input end of said main frame.

18. A machine as defined in claim 1 including a long stroke cylinder mounted on said main frame, and a pair of log tongs mounted on a piston rod in said cylinder for pulling one end of a log onto said input end of said main frame.

19. A machine as defined in claim 1 including a pair of upright posts on said input end of said main frame, a pair of forwardly extending guide arms mounted on said posts, a cable winch mounted on said posts, a long stroke cylinder mounted at its balance point on one of said posts, and a pair of log tongs mounted on a piston rod in said cylinder.

20. A machine as defined in claim 1 including a pair of forwardly extending guide arms on said input end of said main frame having knife edge ends for side limbing said log, and a forwardly extending arm having a profiled knife edge for top limbing said log.

21. The method of cutting a log comprising advancing one end of the log into a movable shear blade frame in position for the first cut with the shear blade frame in starting position, advancing a shear blade in said frame less than entirely through the log, advancing said shear blade frame and log to a second position, actuating said shear blade to complete said first cut, retracting said shear blade, retracting said shear blade frame to said starting position while holding the log stationary, against advancing the shear blade in said frame less than entirely through the log in position for a second cut, and repeating the cycle of reciprocating the shear blade and shear blade frame to cut the log into pieces of desired length.

22. The method of claim 21 including the step of utilizing said shear blade as a ram to force the leading end of the log against a stationary splitter to split the leading end of the log each time the shear blade frame is advanced.

* * * * *

UNITED STATES PATENT AND TRADEMARK OFFICE

CERTIFICATE OF CORRECTION

PATENT NO. : 4,483,379

DATED : November 20, 1984

INVENTOR(S) : Warren A. Aikins and Dr. Thomas N. Melin

It is certified that error appears in the above-identified patent and that said Letters Patent are hereby corrected as shown below:

Column 9, line 4, "against" should read --again--.

Signed and Sealed this

*Ninth* Day of *April 1985*

[SEAL]

*Attest:*

DONALD J. QUIGG

*Attesting Officer* *Acting Commissioner of Patents and Trademarks*